US009975722B2

(12) United States Patent
Yamada

(10) Patent No.: US 9,975,722 B2
(45) Date of Patent: May 22, 2018

(54) SHEET DISCHARGE APPARATUS AND IMAGE FORMING APPARATUS

(71) Applicant: CANON KABUSHIKI KAISHA, Tokyo (JP)

(72) Inventor: Masakatsu Yamada, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/286,978

(22) Filed: Oct. 6, 2016

(65) Prior Publication Data

US 2017/0123363 A1 May 4, 2017

(30) Foreign Application Priority Data

Oct. 30, 2015 (JP) ..... 2015-213885

(51) Int. Cl.

*B65H 31/00* (2006.01)
*B65H 29/52* (2006.01)
*G03G 15/00* (2006.01)
*B65H 31/02* (2006.01)

(52) U.S. Cl.

CPC ..... *B65H 29/52* (2013.01); *B65H 31/02* (2013.01); *G03G 15/6529* (2013.01); *G03G 15/6552* (2013.01); *B65H 2301/4212* (2013.01); *B65H 2405/1111* (2013.01); *B65H 2405/11151* (2013.01); *B65H 2405/141* (2013.01);

(Continued)

(58) Field of Classification Search

CPC ..... B65H 29/20; B65H 29/22; B65H 29/52; B65H 31/00; B65H 31/40; B65H 2405/111; B65H 2405/1111; B65H 2405/1112; B65H 2405/141; B65H 2405/1412

USPC ..... 271/209, 211

See application file for complete search history.

(56) References Cited

U.S. PATENT DOCUMENTS 5,659,386 A 8/1997 Yamada
5,791,642 A * 8/1998 Sawano ..... B65H 31/02 270/58.01

(Continued)

FOREIGN PATENT DOCUMENTS

JP 2004-010188 A 1/2004
JP 2013237544 A * 11/2013 ..... B65H 31/00
JP 2013237544 A * 11/2013 ..... B65H 31/00

*Primary Examiner* — Prasad V Gokhale
(74) *Attorney, Agent, or Firm* — Fitzpatrick, Cella, Harper & Scinto

(57) ABSTRACT

A sheet discharge apparatus includes a discharge unit, a supporting portion, and a regulation portion. The discharge unit is configured to discharge a sheet. The supporting portion is configured to support the discharged sheet. The regulation portion is configured to regulate a trailing edge position of the discharged sheet in a sheet discharge direction. The supporting portion includes a base surface, a first projection portion, and a second projection portion. The first projection portion projects from the base surface, is disposed downstream of the regulation portion in the sheet discharge direction, and extends in a width direction orthogonal to the sheet discharge direction. The second projection portion projects from the base surface, is disposed downstream of the first projection portion in the sheet discharge direction with a predetermined interval from the first projection portion, and is shorter than the first projection portion in the width direction.

21 Claims, 5 Drawing Sheets

(52) U.S. Cl.
CPC ..... *B65H 2405/1412* (2013.01); *B65H 2601/325* (2013.01); *B65H 2801/06* (2013.01)

(56) References Cited

U.S. PATENT DOCUMENTS

| | | | | |
|---|---|---|---|---|
| 6,095,516 | A * | 8/2000 | Sawano | B65H 31/02 271/207 |
| 6,792,241 | B2 | 9/2004 | Nakagawa et al. | |
| 6,923,438 | B2 * | 8/2005 | Matsuyama | B65H 31/30 271/207 |
| 7,484,729 | B2 * | 2/2009 | Ono | B65H 31/02 271/207 |
| 8,579,282 | B2 * | 11/2013 | Yoshida | B65H 31/02 271/209 |
| 2003/0222392 | A1 * | 12/2003 | Matsuyama | B65H 31/30 271/1 |
| 2006/0017219 | A1 * | 1/2006 | Yamada | B65H 31/02 271/209 |
| 2012/0038101 | A1 * | 2/2012 | Osaki | B65H 31/26 271/209 |
| 2012/0242035 | A1 * | 9/2012 | Yoshida | B65H 31/02 271/220 |
| 2017/0036877 | A1 * | 2/2017 | Izumichi | B65H 29/52 |

* cited by examiner

SHEET DISCHARGE APPARATUS AND IMAGE FORMING APPARATUS

BACKGROUND OF THE INVENTION

Field of the Invention

The present invention relates to a sheet discharge apparatus configured to discharge a sheet and to an image forming apparatus including the sheet discharge apparatus.

Description of the Related Art

Generally, an image forming apparatus such as a copier, a printer, and a facsimile machine, that includes a discharged sheet supporting portion configured to support a discharged sheet is known. Japanese Patent Application Laid-Open Publication No. 2004-10188 discloses providing a discharged sheet supporting portion of an image forming apparatus with a supporting surface configured to support a discharged sheet in the aim of keeping a good state of the supported sheet and facilitating picking up the sheet.

In the image forming apparatus described above, a recess portion for taking out a sheet is defined in the supporting surface. The recess portion extends from a downstream end portion toward an upstream end portion of the supporting surface in a sheet discharge direction. The recess portion is defined in a shape in which a more downstream portion in the sheet discharge direction is wider, and a downstream end portion of the recess portion connects to the outside of the image forming apparatus.

However, in the case of using the image forming apparatus disclosed in Japanese Patent Application Laid-Open Publication No. 2004-10188 described above, an operator, i.e., a user, can put his/her fingers under the sheet to hold the sheet only from the downstream side of the supporting surface in the sheet discharge direction. That is, in the case where the downstream side in the sheet discharge direction is on the right side when seen from the operator, the sheet is difficult to take out with the left hand. This leads to limit methods for taking out the sheet. Thus, the operability in taking out the sheet has been not good for left-handed operators.

Moreover, in the case where the discharged sheet is small in size and is displaced in a width direction orthogonal to the sheet discharge direction, it may sometimes become difficult to properly hold the sheet to take out the sheet.

SUMMARY OF THE INVENTION

According to an aspect of the present invention, a sheet discharge apparatus includes a discharge unit, a supporting portion, and a regulation portion. The discharge unit is configured to discharge a sheet. The supporting portion is configured to support the sheet discharged by the discharge unit. The regulation portion is configured to regulate a trailing edge position of the sheet discharged onto the supporting portion in a sheet discharge direction. The supporting portion includes a base surface, a first projection portion, and a second projection portion. The first projection portion projects from the base surface, is disposed downstream of the regulation portion in the sheet discharge direction, and extends in a width direction orthogonal to the sheet discharge direction. The second projection portion projects from the base surface, is disposed downstream of the first projection portion in the sheet discharge direction with a predetermined interval from the first projection portion, and is formed so as to be shorter than the first projection portion in the width direction.

Further features of the present invention will become apparent from the following description of exemplary embodiments with reference to the attached drawings.

DESCRIPTION OF THE EMBODIMENTS

Image Forming Apparatus

Figure 1:
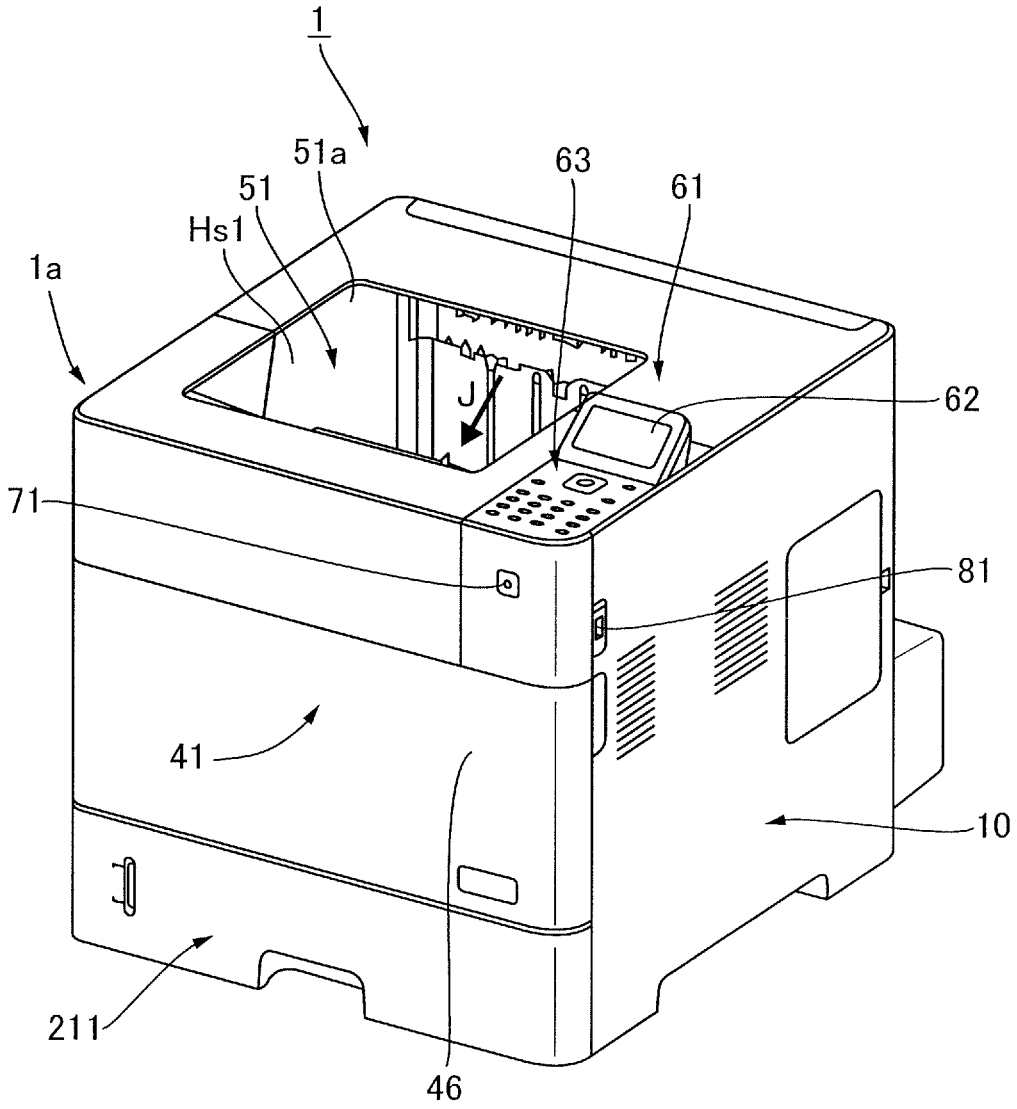
FIG. 1 is a perspective view illustrating the outer appearance of an image forming apparatus according to an exemplary embodiment.

An exemplary embodiment of the present invention will be described below with reference to the drawings. FIG. 1 is a perspective view illustrating the outer appearance of an image forming apparatus 1 according to the present exemplary embodiment. In the following description, a state where a multifunctional cover 46 of the image forming apparatus 1 is seen directly from the front is set as the standard, and positional relationships concerning up, down, right, and left will be thereby expressed.

Figure 2:
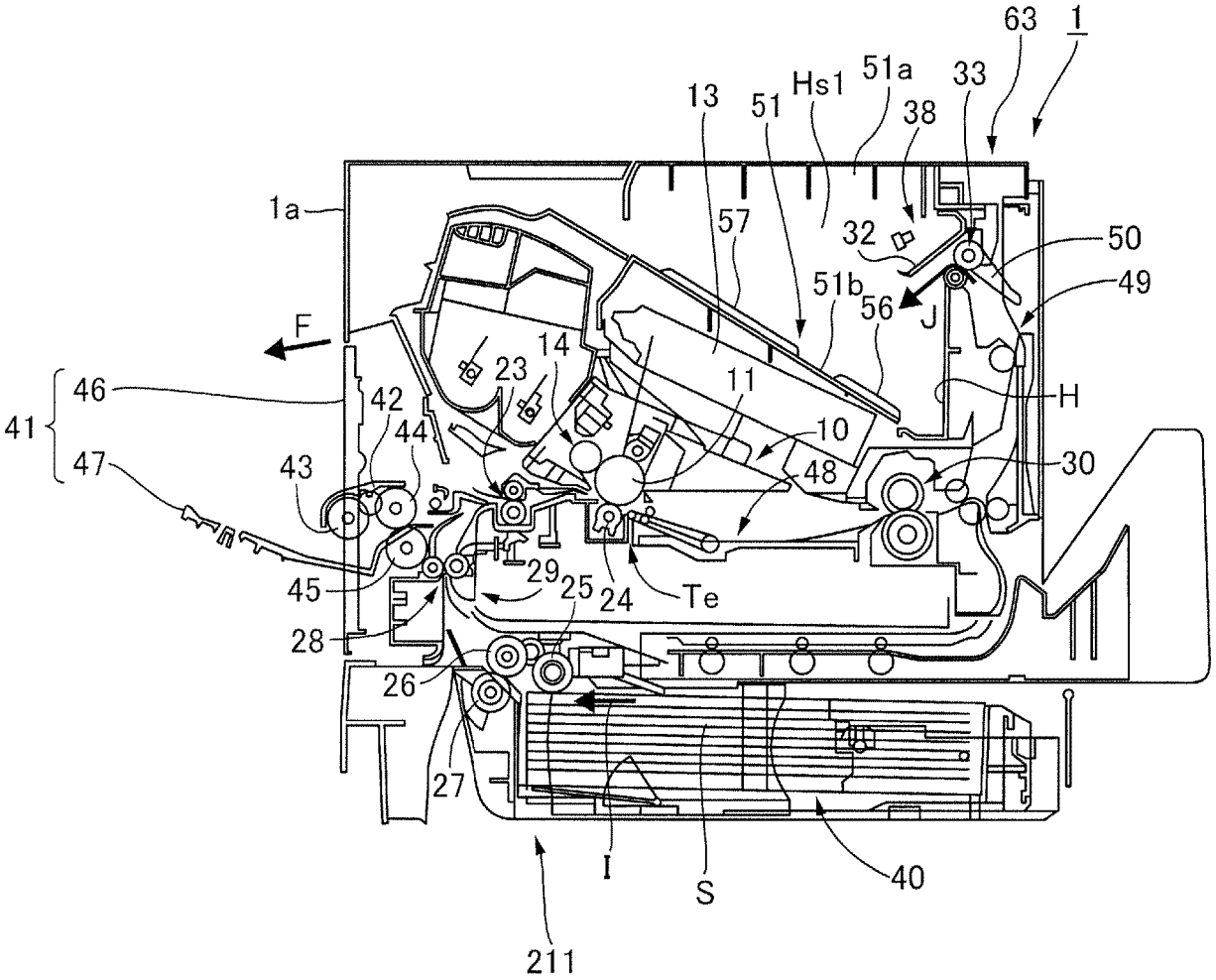
FIG. 2 is a section view schematically illustrating a configuration of the image forming apparatus.

As illustrated in FIG. 1, the image forming apparatus 1 is a full-color laser beam printer configured to perform image formation by using electrophotography and includes an image forming apparatus body 1*a*. The image forming apparatus body 1*a* will be hereinafter referred to as an apparatus body 1*a*. An image forming unit 10 configured to form an image and a sheet feeding unit 211 configured to feed a sheet to the image forming unit 10 are disposed in the apparatus body 1*a*. A discharged sheet supporting portion 51 is provided at the center of an upper portion of the apparatus body 1*a*. As illustrated in FIG. 2, the discharged sheet supporting portion 51 includes a supporting surface 51*b* configured to support a sheet that has been discharged after an image has been formed thereon. In addition, an operation unit 61 is disposed on a front end portion of the upper surface of the apparatus body 1*a*. An operator, i.e. a user, can take out the discharged sheet by inserting a hand into an opening portion 51*a* and holding the discharged sheet. The opening portion 51*a* is defined above the discharged sheet supporting portion 51 in an approximately rectangular shape. The operation unit 61 includes a liquid crystal display 62, i.e. LCD 62, and an input unit 63. The LCD 62 is configured to display various setting conditions of the image forming apparatus 1 and information for configuring various settings. The input unit 63 includes operation buttons for performing various inputs.

A multifunctional feeding unit 41 including the multifunctional cover 46 is provided in a front portion of the apparatus body 1*a*. The multifunctional cover 46 is supported by the apparatus body 1*a* so as to be openable and closable. A power switch 71 is disposed to the upper right of the multifunctional cover 46. The power switch 71 turns the power of the image forming apparatus 1 on in the case where the power switch 71 is pressed when the power of the image forming apparatus 1 is off. This enables, for example, operation with the operation unit 61 and image output from a personal computer that is not illustrated. Further, in the apparatus body 1*a*, a universal serial bus socket 81, i.e. USB socket 81, is disposed near the power switch 71. An external memory device such as a USB memory that is not illustrated is connected to the image forming apparatus 1 through the USB socket 81. This enables outputting document data or image data stored in the external memory device from the image forming apparatus 1 as an image by an operation input through the operation unit 61 without using a personal computer.

Next, the image forming apparatus 1 including a sheet discharge apparatus 38 according to the present exemplary embodiment will be described in detail with reference to FIG. 2. FIG. 2 is a section view schematically illustrating the overall configuration of the image forming apparatus 1.

Figure 3:
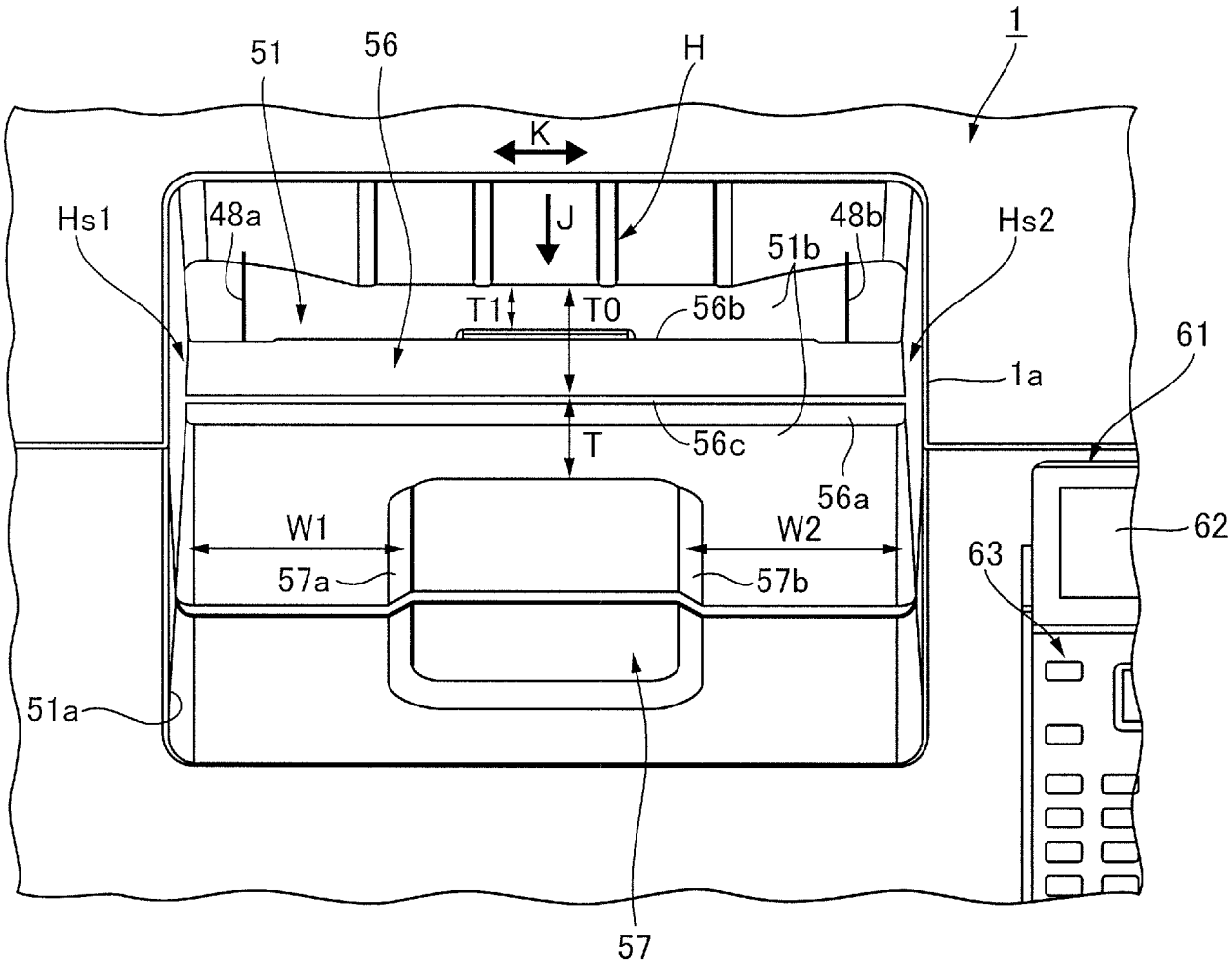
FIG. 3 is a plan view illustrating a discharged sheet supporting portion and a structure around the discharged sheet supporting portion.
Figure 4:
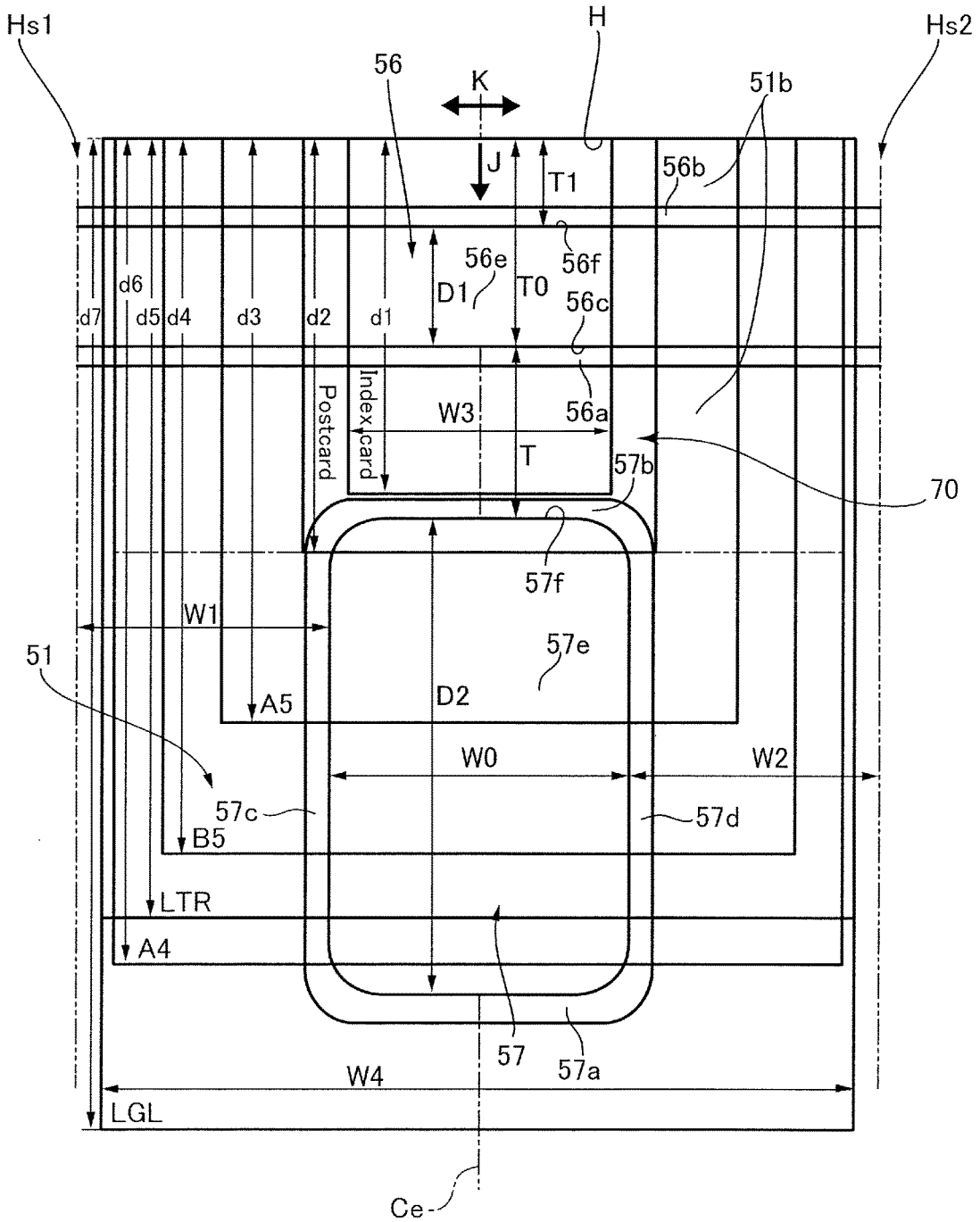
FIG. 4 is a plan view illustrating a first projection portion and a second projection portion provided on the discharged sheet supporting portion.

As illustrated in FIG. 2, the image forming apparatus 1 includes the sheet feeding unit 211, the image forming unit 10, and the sheet discharge apparatus 38 in this order from the bottom of the apparatus body 1*a*, and the multifunctional feeding unit 41 in a side portion. The sheet discharge apparatus discharges a sheet on which an image has been formed. The sheet discharge apparatus 38 includes a discharge roller pair 33 and the discharged sheet supporting portion 51. Side walls Hs1 and Hs2 illustrated in FIGS. 3 and 4 are provided at both ends of the discharged sheet supporting portion 51 in a width direction K illustrated in FIG. 3 orthogonal to a sheet discharge direction J serving as a discharge direction. The multifunctional feeding unit 41 includes a multifunctional tray 47 and the multifunctional cover 46. The multifunctional tray 47 is supported in the apparatus body 1*a* so as to be openable and closable. The multifunctional cover 46 is supported so as to be openable and closable to cover the multifunctional tray 47 in a state where the multifunctional tray 47 is closed to the apparatus body 1*a* side.

The sheet feeding unit 211 includes a sheet feeding cassette 40 and a sheet feeding portion 29. The sheet feeding cassette stores a sheet S. A pulling-out roller pair 28, a pickup roller 25, a conveyance roller 26, and a separation roller 27 are disposed in the sheet feeding portion 29. The pickup roller 25, the conveyance roller 26, and the separation roller 27 feed the sheet S stored in the sheet feeding cassette 40 to the pulling-out roller pair 28. The sheet feeding cassette 40 is supported so as to be capable of being attached to and being drawn out from the apparatus body 1*a* toward the front and toward the back, respectively. The pickup roller 25, the conveyance roller 26, and the separation roller 27 are each disposed above and downstream of the sheet feeding cassette 40 in a sheet feeding direction I so as to be rotatable.

The pickup roller 25 and the conveyance roller 26 are connected to each other via a feed holder that is not illustrated. The pickup roller 25 is supported by the feed holder so as to move about a rotation shaft of the conveyance roller 26 to come into and out of contact with the sheet S stored in the sheet feeding cassette 40. The pickup roller 25 feeds the sheet S in the sheet feeding direction I by rotating in a clockwise direction in FIG. 2 in a state of being in pressure contact with the sheet S. The separation roller 27 separates a plurality of sheets S stored in the sheet feeding cassette 40 at a separation nip portion formed between the separation roller 27 and the conveyance roller 26, and the uppermost sheet is fed in the sheet feeding direction I.

The image forming unit 10 includes a registration roller pair 23 that temporarily receives the sheet S that has been fed by the pickup roller 25, the conveyance roller 26, and the separation roller 27 and conveyed through the pulling-out roller pair 28. The registration roller pair 23 feeds the sheet S at a timing matching the timing of image formation by the image forming unit 10. A photosensitive drum 11, a transfer roller 24, and a fixing apparatus 30 are disposed in a first conveyance path 48 provided in the image forming unit 10. The photosensitive drum 11 is formed of a photoconductor. The transfer roller 24 comes into pressure contact with the photosensitive drum 11 from below to form a transfer portion Te. The fixing apparatus 30 is disposed downstream of the transfer portion Te in a sheet conveyance direction. At the transfer portion Te serving as an image forming portion, a toner image on the photosensitive drum 11 is transferred onto the sheet S passing through the transfer portion Te.

A second conveyance path 49 extending in an up-down direction, i.e. vertical direction, is provided downstream of the fixing apparatus 30. The discharge roller pair 33, an upstream guide member 50, and a downstream guide member 32 are disposed in the second conveyance path 49. The discharge roller pair 33 serving as a discharge unit discharges the sheet S on which the toner image has been fixed by the fixing apparatus 30 and which has been conveyed to the discharge roller pair 33 onto the discharged sheet supporting portion 51. The upstream guide member 50 guides the sheet S conveyed from the fixing apparatus 30 to the discharge roller pair 33. The downstream guide member 32 guides the sheet S discharged by the discharge roller pair 33 to the discharged sheet supporting portion 51. The transfer roller 24 transfers the toner image on the photosensitive drum 11 onto the sheet S, and then conveys the sheet S to the fixing apparatus 30. The image forming unit 10 also includes an exposing unit 13, a developing unit 14, and so forth. The exposing unit forms a latent image, i.e. electrostatic latent image, on the surface of the photosensitive drum 11 by irradiating the surface with laser light. The developing unit 14 forms the toner image by providing stored toner to the latent image on the photosensitive drum 11.

In the multifunctional feeding unit 41, a pickup roller 43, a conveyance roller 44, and a separation roller 45 are disposed further on the inside than the multifunctional cover 46. The pickup roller 43, the conveyance roller 44, and the separation roller 45 spread so as to project toward the outside when the multifunctional cover 46 is open. The conveyance roller 44 feeds a sheet S fed from the multifunctional tray 47 by the pickup roller 43 to the registration roller pair 23. The separation roller 45 separates sheets fed by the pickup roller 43 from one another at a separation nip portion formed by the separation roller 45 and the conveyance roller 44. The pickup roller 43 and the conveyance roller 44 are connected to each other via a feed holder 42.

The image forming apparatus 1 is capable of feeding the sheet S not only from the sheet feeding cassette 40 but also from the multifunctional feeding unit 41. The multifunctional tray 47 comes out of the apparatus body 1*a* when the multifunctional cover 46 is opened in an arrow F direction, and a user puts the sheet S on the multifunctional tray 47. The pickup roller 43 abuts the sheet S on the multifunctional tray 47 by moving about a rotation shaft of the conveyance roller 44 via the feed holder 42. Then, the rotation of the pickup roller 43 advances the sheet S on the multifunctional tray 47, and the sheet S separated from sheets by the conveyance roller 44 and the separation roller 45 is fed to the registration roller pair 23. The operation by the image forming apparatus 1 at a section downstream of the registration roller pair 23 in the sheet conveyance direction is the same as the case of feeding the sheet S from the sheet feeding cassette 40.

Generally, it is often the case that sheets of a frequently used size such as A4 are set in the sheet feeding cassette 40 and sheets of a less frequently used size are set in the multifunctional feeding unit 41 to be fed. This reduces labor of changing the sheet set in the sheet feeding cassette and enables using sheets of various sizes. The multifunctional cover 46 is closed with respect to the apparatus body 1*a* in the case where the multifunctional feeding unit 41 is not used, and the multifunctional cover 46 is opened along with the multifunctional tray 47 to use the multifunctional feeding unit 41 in the case where the multifunctional feeding unit 41 is to be used.

Configuration of and Around Discharged Sheet Supporting Portion

Next, the configuration of and around the discharged sheet supporting portion 51 of the image forming apparatus 1 according to the present exemplary embodiment will be described with reference to FIG. 3. FIG. 3 schematically illustrates the configuration of and around the discharged sheet supporting portion 51 according to the present exemplary embodiment.

That is, as illustrated in FIG. 3, the discharged sheet supporting portion 51 serving as a supporting portion of the image forming apparatus 1 includes the supporting surface 51*b*, a first projection portion 56, and a second projection portion 57. The supporting surface 51*b* serves as a base surface, and the first projection portion 56 is formed so as to project upward from the supporting surface 51*b*. The second projection portion 57 is disposed downstream of the first projection portion 56 in the sheet discharge direction J and formed so as to project upward from the supporting surface 51*b*. The first projection portion 56 is formed so as to extend in a belt-like shape in the width direction K orthogonal to the sheet discharge direction J, and is provided so as to reach both of the side walls Hs1 and Hs2 provided at ends of the supporting surface 51*b* in the width direction K. The second projection portion 57 is formed in an approximately rectangular shape at a center portion of the supporting surface 51*b* in the width direction K.

The discharged sheet supporting portion 51 further includes a regulation portion H provided on an upstream portion of the discharged sheet supporting portion 51 in the sheet discharge direction J of so as to extend in the width direction K illustrated in FIG. 4. The regulation portion H regulates the trailing edge of the sheet discharged onto the discharged sheet supporting portion 51. The discharged sheet supporting portion 51 is inclined upward such that the height of the discharged sheet supporting portion 51 gradually increases from upstream to downstream in the sheet discharge direction J. In addition, a space is provided between the discharged sheet supporting portion 51 and the discharge roller pair 33 such that the discharged sheet supporting portion 51 is capable of supporting about 500 sheets thereon. The discharged sheet supporting portion 51 opposes the regulation portion H in a drawing-out direction of the sheet feeding cassette 40. In addition, ribs 48*a* and 48*b* are provided at a portion that is between the first projection portion 56 and the regulation portion H and is near the ends of the discharged sheet supporting portion 51 in the width direction K.

As described above, the discharged sheet supporting portion 51 is inclined such that the height of the discharged sheet supporting portion 51 decreases upstream in the sheet discharge direction J. The discharged sheet supporting portion is configured such that the sheet discharged by the discharge roller pair 33 slides down along the inclination of the discharged sheet supporting portion 51 and the trailing end of the sheet is aligned with the regulation portion H on the discharge roller pair 33 side. As a result of this, in the case where a plurality of sheets are discharged, the trailing ends of the sheets are easily aligned with each other. Further, the discharged sheet supporting portion 51 is configured such that a stack of sheets supported on the discharged sheet supporting portion 51 with the trailing ends thereof aligned with each other can be easily taken out from the opening portion 51*a*.

The heights of the first projection portion 56 and the second projection portion 57 from the supporting surface 51*b* illustrated in FIG. 3 are each set to the minimum height required for taking out the sheet supported on the supporting surface 51*b* by holding the sheet with fingers, and are each set to, for example, 5 mm in the present exemplary embodiment. The sheet is easier to take out by holding with fingers in the case where the height is set to a higher value, for example, about 10 mm. On the other hand, if the height is set to a higher value, the amount of sheets that can be supported on the discharged sheet supporting portion 51 will decrease. Therefore, the height is set to the minimum value in the present exemplary embodiment.

Arrangement of First Projection Portion and Second Projection Portion

The arrangement of the first projection portion 56 and the second projection portion 57 will be described next with reference to FIG. 4. FIG. 4 illustrates the arrangement of the first projection portion 56 and the second projection portion 57, and the relationship between the sizes of the projection portions 56 and 57 and sheets that can be subjected to printing by, i.e. usable in, the image forming apparatus 1.

In FIG. 4, the trailing end of each sheet of standard size in the sheet discharge direction J is aligned with the regulation portion H. An upstream inclined surface 56*b* and a downstream inclined surface 56*a* are respectively formed on the upstream side surface and the downstream side surface of the first projection portion 56 in the sheet discharge direction J. The downstream inclined surface 56*a* and the upstream inclined surface 56*b* are inclined from a flat upper surface portion 56*e* toward the supporting surface 51*b*.

The second projection portion 57 includes an upstream inclined surface 57*b* and a downstream inclined surface 57*a* on an upstream side surface and on a downstream side surface, respectively. In addition, the second projection portion 57 includes a side inclined surface 57*c* on a first end in the width direction K and a side inclined surface 57*d* on a second end in the width direction K. The upstream inclined surface 57*b*, the downstream inclined surface 57*a*, and the side inclined surfaces 57*c* and 57*d* are each inclined from a flat upper surface portion 57*e* of the second projection portion 57 toward the supporting surface 51*b* so as to become gradually wider toward the supporting surface 51*b*. The second projection portion 57 is formed such that the length D2 of the second projection portion 57 in the sheet discharge direction J, i.e. discharge direction, is larger than the length D1 of the first projection portion 56 in the sheet discharge direction J.

The first projection portion 56 is provided so as to extend parallel to the regulation portion H in the width direction K at a position downstream of the regulation portion H in the sheet discharge direction J with a distance T1 from the regulation portion H. A distance T0 between the regulation portion H and a downstream end portion 56*c* of the first projection portion 56 in the sheet discharge direction J is set to be shorter than a length d1 of a sheet of a minimum standard size in the sheet discharge direction J and longer than a half of the length d1. In this case, the distance T0 does not include the downstream inclined surface 56*a* of the first projection portion 56. The distance T1 is set to be shorter than a length W3 of a minimum size sheet in the width direction K, and thus the minimum size sheet comes into contact with the first projection portion 56 without fail even in the case where the minimum size sheet is discharged in a state rotated by 90°. Therefore, the user can put the hand into a gap between the regulation portion H and the first projection portion 56 to remove the sheet.

In FIG. 4, the lengths of sheets of a minimum non-standard usable size, a postcard size that is a minimum standard usable size, and an A5 size that is a usable standard size in the sheet discharge direction J are respectively illustrated as d1, d2, and d3. In addition, the lengths of sheets of a B5 size, a LTR size, i.e. letter size, a A4 size, and a LGL size, i.e. legal size, that are usable standard sizes are respectively illustrated as d4, d5, d6, and d7.

The distance T0 described above is set to be shorter than the length d1 of an index card, which is the sheet of the minimum standard size that can be subjected to printing by the image forming apparatus 1, and longer than a half of the length d1, i.e. d1/2. Therefore, even the sheet of the minimum size is supported on the first projection portion 56 without fail in a state where a downstream portion of the sheet in the sheet discharge direction J is away in the air from the supporting surface 51*b*. This enables easily taking out the sheet from the discharged sheet supporting portion 51 by holding the portion in the air of the sheet. In the present exemplary embodiment, the length d1 of the minimum size sheet is, for example, 127 mm, and the distance T0 is set to 73 mm, which is a little longer than a half of d1, i.e. d1/2.

In addition, a length W0+W1+W2 of the first projection portion 56 in the width direction K is set to be a little larger than or approximately the same as a length W4 of a sheet of an LTR or LGL size which is the maximum standard size in the width direction K. That is, the length of the first projection portion 56 in the width direction K may be set to be approximately the same as the width of the sheet of the maximum standard size or the width of the supporting surface 51*b*. In the present exemplary embodiment, the first projection portion 56 having the belt-like shape is provided so as to reach both the side walls Hs1 and Hs2 provided at ends of the supporting surface 51*b* of the discharged sheet supporting portion 51 in the width direction K.

The above configuration is adopted such that the discharged sheet is supported to be flat in the width direction K at an upstream portion of the discharged sheet supporting portion 51 in the sheet discharge direction J, and the stackability of sheets is thereby increased. Further, the above configuration is adopted such that the minimum size sheet is supported in the air without fail and can be easily taken out from the opening portion 51*a* even in the case where the sheet is displaced on the first projection portion 56 in the width direction K. Moreover, with the configuration above, a downstream portion of the sheet in the sheet discharge direction J can be supported in the air in the whole region in the width direction K and thus the sheet can be easily taken out even in the case where the sheet is of a non-standard size, is as short as the minimum size sheet in the sheet discharge direction J, and is wide in the width direction K.

Meanwhile, the second projection portion 57 provided downstream of the first projection portion 56 in the sheet discharge direction J is disposed at the center portion of the discharged sheet supporting portion 51 in the width direction K. In other words, the second projection portion 57 is formed so as to occupy the center of the supporting surface 51*b* in the width direction K. An upstream end portion 57*f* of the second projection portion 57 is provided at a position which the downstream end of the minimum size sheet does not reach and which is separated from a downstream end portion 56*c* of the first projection portion 56 by an interval T. The interval T does not include the downstream inclined surface 56*a* of the first projection portion 56 and the upstream inclined surface 57*b* of the second projection portion 57.

That is, the distance T0+T between the regulation portion H and the upstream end portion 57*f* of the second projection portion 57 is set to be longer than the length d1 of the sheet of the minimum standard size in the sheet discharge direction J. In other words, T0+T>d1 is satisfied. Specifically, T0, T, and d1 may be set to, for example, about mm, about 60 mm, and 127 mm, respectively. A line Ce illustrated in FIG. 4 is a center line of the supporting surface 51*b* that coincides with a center position of the sheet discharged by the discharge roller pair 33 after being subjected to image formation with setting the center as a standard. That is, the center of the discharged sheet supporting portion 51 in the width direction K coincides with the center of the sheet discharged by the discharge roller pair 33.

The second projection portion 57 is provided to be separated from the downstream end portion 56*c* of the first projection portion 56 by the distance T, i.e. with a predetermined interval T therebetween. Further, the second projection portion 57 is formed such that the length W0 in the width direction K is smaller than a length W0+W1+W2 in the width direction K of the first projection portion 56. The second projection portion 57 is provided so as to be approximately centered with respect to the sheet discharge direction J. That is, the second projection portion 57 is formed symmetrical with respect to the center line Ce. The length W0 of the second projection portion 57 in the width direction K is set to be larger than the width of the sheet of the minimum standard size and smaller than a half of a length W4 of the sheet of the maximum standard size. The length W0 does not include the side inclined surfaces 57*c* and 57*d* of the second projection portion 57.

The above configuration enables easily taking out the sheet supported on the discharged sheet supporting portion 51 while securing the stackability of sheets discharged by the discharge roller pair 33. That is, in the case where the sheet is not long enough to reach the second projection portion 57 and is wider than the second projection portion 57, the operator can insert the hand from the longitudinal direction to take out the sheet. In this case, the operator can insert the hand from either side of the second projection portion 57. In the case where the sheet is of a size with which the sheet reaches the second projection portion 57 and a part of the sheet is supported on the second projection portion 57, an upstream portion of the sheet in the sheet discharge direction J is supported on the first projection portion 56 in the whole width region of the sheet. In this case, a downstream portion of the sheet in the sheet discharge direction J is supported on the second projection portion 57 in a center portion of the sheet width.

In the case where the sheet is not long enough to reach the second projection portion 57 and is narrower than the second projection portion 57, the operator can insert the hand into the gap between the first projection portion 56 and the second projection portion 57 from either side in the lateral direction to take out the sheet. The operator can easily take out the sheet even in the case where the sheet is of a small size as described above and the sheet is displaced in the width direction K before taking out the sheet. The downstream inclined surface 56*a* of the first projection portion 56, the upstream inclined surface 57*b* of the second projection portion 57, and the supporting surface 51*b* defines a recess portion 70 provided between the first projection portion 56 and the second projection portion 57 in the sheet discharge direction J as illustrated in FIG. 4. The recess portion 70 provides a space under the sheet supported by the first projection portion 56 and the second projection portion 57. This space enables the user to insert the hand under the sheet and thus facilitates taking out of the sheet.

In addition, disposing the second projection portion 57 so as to be approximately centered with respect to the sheet discharge direction J not only lets the sheet supported on the supporting surface 51*b* to be stably supported without becoming eccentric in the width direction K but also enables taking out the sheet from both sides of the second projection portion 57. Accordingly, the operator can easily take out the sheet no matter whether the operator is right-handed or left-handed. The second projection portion 57 may not be provided symmetrical with respect to the center line Ce as long as the second projection portion 57 is provided so as to be separated from the side walls Hs1 and Hs2.

The sheet can be more stably supported in the case where the length W0 of the upper surface portion 57*e* of the second projection portion 57 is larger. However, the side inclined surfaces 57*c* and 57*d* are provided for the ease of taking out the sheet. The side inclined surfaces 57*c* and 57*d* provides a space in the width direction K of the second projection portion 57. The space is one step lower than the upper surface portion 57*e*.

In the case where the sheet is long enough in the sheet discharge direction J to reach the upstream end portion 57*f* of the second projection portion 57 and is wider than the length W0 of the second projection portion 57 in the width direction K, the operator can insert the hand from the longitudinal direction to take out the sheet. In this case, the operator can insert the hand from either side of the second projection portion 57. In the case where the sheet is long enough to reach the second projection portion 57 and is narrower than the second projection portion 57, the operator can insert the hand into the portion of the interval T, that is, the recess portion 70, between the first projection portion 56 and the second projection portion 57 from the lateral direction to hold and take out the sheet. In this case, the operator can insert the hand from either side of the recess portion 70.

In the present exemplary embodiment, the interval T may be set to about 60 mm. This is set to be a little wider than the total width of three fingers including an index finger, a middle finger, and a ring finger such that the operator can easily insert the fingers from the width direction K. Although the interval T is sufficient when set to be a little wider than the total width of the three fingers including the index finger, the middle finger, and the ring finger, in the case of inserting the fingers from the width direction K, the interval T may be set to be a little wider than the exemplary value shown above such that the operator can insert four fingers including a little finger in addition to the three fingers. In this case, the interval T may be set to, for example, about 75 mm.

However, in the case where the interval T is set to about 75 mm, T0+T is 148 mm. Since a postcard with a length of 148 mm is included as a sheet of standard size in the present exemplary embodiment, whether the postcard reaches the second projection portion 57 or not is indefinite in this case. Therefore, it is preferable to set the interval T to about 60 mm such that the downstream end portion of the postcard is supported on the upper surface portion 57*e* near the upstream inclined surface 57*b*.

The length W0 of the upper surface portion 57*e* of the second projection portion 57 is set to be larger than the length W3 of the minimum usable size in the width direction K and smaller than a half of the length W4 of the maximum usable size. Here, the lengths W0, W3, and W4 are, for example, about 85 mm, 76 mm, and 216 mm, respectively. As a result of this, the width W1 between the left side end of the upper surface portion 57*e* of the second projection portion 57 and the width W2 between the right side end of the upper surface portion 57*e* of the second projection portion 57 that are required for taking out the sheet are each set to about 75 mm. This secures spaces a little wider than the total width of the four fingers except the thumb in a state where the four fingers are aligned with each other. Here, W1 and W2 do not include the side inclined surfaces 57*c* and 57*d*.

Comparative Embodiment

Figure 5:
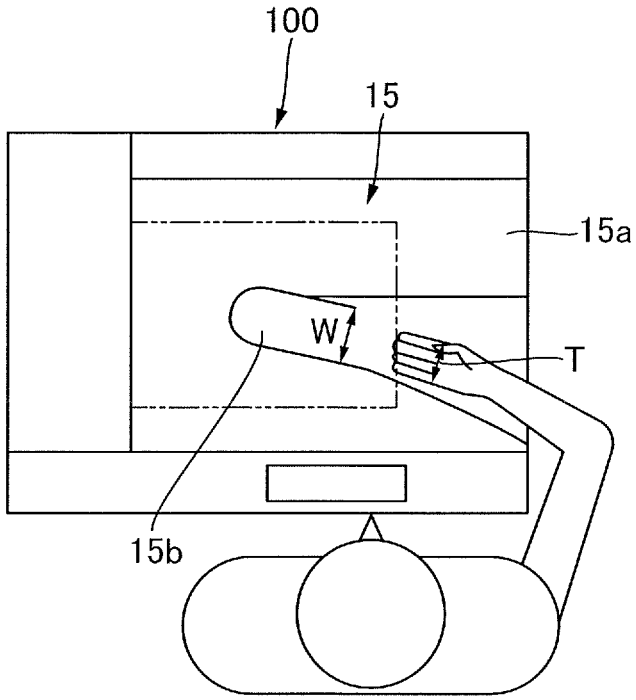
FIG. 5 is a plan view illustrating an image forming apparatus of a comparative embodiment including a discharged sheet supporting portion of a conventional type.

FIG. 5 is a plan view illustrating a state where an operator takes out a sheet from an image forming apparatus 100 including a discharged sheet supporting portion 15 of a conventional type. The discharged sheet supporting portion 15 of the image forming apparatus includes a supporting surface 15*a* so as to facilitate taking out of the sheet while keeping a good stackability of the sheet. A downstream end portion of the supporting surface 15*a* in a sheet discharge direction is connected to the outside on the side of an apparatus body of the image forming apparatus 100.

The supporting surface 15*a* includes a recess portion 15*b* for taking out the sheet. The recess portion 15*b* is defined in the supporting surface 15*a* so as to extend from the downstream end portion to a portion under a region for supporting a small size sheet through a portion under a region for supporting a maximum size sheet. The recess portion 15*b* is defined such that a width W of the recess portion 15*b* increases toward downstream in the sheet discharge direction. A downstream portion of the recess portion 15*b* is defined such that the edge of a more downstream portion is closer to the front side of the image forming apparatus 100.

With this configuration, the operator can insert the hand only from downstream of the image forming apparatus 100 in the sheet discharge direction to hold the sheet to take out the sheet. That is, in the case where the downstream side in the sheet discharge direction is on the right side when viewed from the operator, the operator can only insert the right hand from one position on the right side. This leads to limit methods of taking out the sheet. Moreover, in the case where the sheet to be discharged is small in size and the sheet is displaced in a width direction orthogonal to the sheet discharge direction, there may be a case where the operator cannot properly hold the sheet even if the operator inserts the hand in the recess portion 15*b*.

In contrast, in the present exemplary embodiment, the operator can hold the sheet to take out the sheet by inserting the fingers into the interval, i.e. the recess portion 70 in FIG. 4, between the first projection portion 56 and the second projection portion 57 from the width direction K in accordance with the size of the sheet to be discharged to the discharged sheet supporting portion 51. The operator can also hold the sheet to take out the sheet by inserting the fingers into the interval with the distance T1 between the regulation portion H and the upstream end portion 56*f* of the first projection portion 56 from the width direction K.

Alternatively, the operator can hold the sheet to take out the sheet by inserting the fingers under the sheet toward upstream in the sheet discharge direction J from either side of the second projection portion 57. Moreover, since the second projection portion 57 is disposed so as to be centered with respect to the sheet discharge direction J, the operator can take out the sheet from either side of the second projection portion 57 in all of the above-described cases.

As described above, according to the present exemplary embodiment, the operator can use various methods to take out the sheet in accordance with the size of the sheet. Therefore, for various sizes, the operator can easily take out the sheet. In addition, the operator can easily take out the sheet even in the case where the sheet is narrow and is displaced in the width direction K because the operator can insert the hand into the recess portion 70 between the first projection portion 56 and the second projection portion 57.

Although the image forming apparatus 1 of an electrophotographic system has been described as the present exemplary embodiment, an image forming apparatus of an inkjet system that forms an image on a sheet by ejecting an ink liquid thorough a nozzle may be used as an example.

Moreover, although the first projection portion 56 and the regulation portion H are provided away from each other by the distance T1 in the present exemplary embodiment, the first projection portion 56 and the regulation portion H may be provided in contact with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213885, filed Oct. 30, 2015, which is hereby incorporated by reference herein in its entirety.

What is claimed is:

1. A sheet discharge apparatus comprising:

a discharge unit configured to discharge a sheet;

a supporting portion configured to support the sheet discharged by the discharge unit; and a regulation portion configured to regulate a trailing edge position of the sheet discharged onto the supporting portion in a sheet discharge direction, wherein the supporting portion comprises a base surface, a first projection portion, and a second projection portion, wherein the first projection portion projects from the base surface, is disposed downstream of the regulation portion in the sheet discharge direction, and extends in a width direction orthogonal to the sheet discharge direction, wherein the second projection portion projects from the base surface, is disposed downstream of the first projection portion in the sheet discharge direction with a predetermined interval from the first projection portion, is shorter than the first projection portion in the width direction, and overlaps a centerline of the base surface in the width direction, and wherein a distance between a downstream end portion of the first projection portion and the regulation portion in the sheet discharge direction is shorter than a length of a sheet of a minimum usable size in the sheet discharge direction.

2. The sheet discharge apparatus according to claim 1, wherein the first projection portion extends across an entire length of the base surface in the width direction.

3. The sheet discharge apparatus according to claim 1, wherein the second projection portion is longer than the first projection portion in the sheet discharge direction.

4. The sheet discharge apparatus according to claim 1, wherein the first projection portion is longer than a sheet of a maximum usable size in the width direction.

5. The sheet discharge apparatus according to claim 1, wherein the first projection portion is provided so as to be separated from the regulation portion.

6. The sheet discharge apparatus according to claim 1, wherein a length of the second projection portion in the width direction is larger than a length of a sheet of a minimum usable size in the width direction and is smaller than a half of a length of a sheet of a maximum usable size in the width direction.

7. The sheet discharge apparatus according to claim 1, wherein a distance between an upstream end portion of the second projection portion in the sheet discharge direction and the regulation portion is longer than a length of a sheet of a minimum usable size in the sheet discharge direction.

8. The sheet discharge apparatus according to claim 1, wherein the base surface, a downstream side surface of the first projection portion, and an upstream side surface of the second projection portion in the sheet discharge direction define a recess portion provided between the first projection portion and the second projection portion in the sheet discharge direction.

9. The sheet discharge apparatus according to claim 1, wherein the supporting portion is inclined upward from upstream toward downstream in the sheet discharge direction and is exposed upward.

10. The sheet discharge apparatus according to claim 9, further comprising a sheet storage portion that is configured to store a sheet and is supported so as to be capable of being inserted and being drawing out, wherein the supporting portion opposes the regulation portion in a drawing-out direction of the sheet storage portion.

11. The sheet discharge apparatus according to claim 1, wherein the discharge unit is configured to discharge the sheet such that a center of the discharged sheet coincides with a center of the supporting portion in the width direction.

12. The sheet discharge apparatus according to claim 1, wherein the second projection portion is shorter than a sheet of a maximum usable size in the width direction.

13. An image forming apparatus comprising:

an image forming unit configured to form an image on a sheet; and the sheet discharge apparatus according to claim 1 configured to discharge the sheet on which the image has been formed by the image forming unit.

14. The sheet discharge apparatus according to claim 1, wherein the first projection portion and the second projection portion are arranged such that the sheet supported on the first projection portion and the second projection portion is apart from a part of the base surface between the first projection portion and the second projection portions.

15. The sheet discharge apparatus according to claim 1, wherein the first projection portion supports a first part of the sheet discharged from the discharge unit, the second projection portion supports a second part of the sheet discharged from the discharge unit, the first projection portion and the second projection portion do not support a third part of the sheet discharged from the discharge unit, the third part of the sheet discharged from the discharge unit being out of contact with the base surface, and the third part of the sheet discharged from the discharge unit overlaps the first part of the sheet discharged from the discharge unit in the width direction, and overlaps the second part of the sheet discharged from the discharge unit in the sheet discharge direction.

16. The sheet discharge apparatus according to claim 1, wherein the predetermined interval between the first projection portion and the second projection portion is shorter than the second projection portion in the sheet discharge direction.

17. The sheet discharge apparatus according to claim 1, wherein the second projection portion is configured to support a gravity center part of a sheet whose trailing edge position is regulated by the regulation portion.

18. The sheet discharge apparatus according to claim 1, wherein the first projection portion comprises a first flat upper surface.

19. The sheet discharge apparatus according to claim 18, wherein the second projection portion comprises a second flat upper surface parallel with the first flat upper surface.

20. A sheet discharge apparatus comprising:

a discharge unit configured to discharge a sheet;

a supporting portion configured to support the sheet discharged by the discharge unit; and a regulation portion configured to regulate a trailing edge position of the sheet discharged onto the supporting portion in a sheet discharge direction, wherein the supporting portion comprises a base surface, a first projection portion, and a second projection portion, wherein the first projection portion projects from the base surface, is disposed downstream of the regulation portion in the sheet discharge direction, and extends in a width direction orthogonal to the sheet discharge direction, wherein the second projection portion projects from the base surface, is disposed downstream of the first projection portion in the sheet discharge direction with a predetermined interval from the first projection portion, is shorter than the first projection portion in the width direction, and overlaps a centerline of the base surface in the width direction, wherein the first projection portion comprises a first flat upper surface, wherein the second projection portion comprises a second flat upper surface, and wherein the first and second flat upper surfaces extend parallel with the base surface.

21. A sheet discharge apparatus comprising:

a discharge unit configured to discharge a sheet;

a supporting portion configured to support the sheet discharged by the discharge unit; and a regulation portion configured to regulate a trailing edge position of the sheet discharged onto the supporting portion in a sheet discharge direction, wherein the supporting portion comprises a base surface, a first projection portion, and a second projection portion, wherein the first projection portion projects from the base surface, is disposed downstream of the regulation portion in the sheet discharge direction, and extends in a width direction orthogonal to the sheet discharge direction, wherein the second projection portion projects from the base surface, is disposed downstream of the first projection portion in the sheet discharge direction with a predetermined interval from the first projection portion, and is shorter than the first projection portion in the width direction, and wherein a distance between a downstream end portion of the first projection portion and the regulation portion in the sheet discharge direction is shorter than a length of a sheet of a minimum usable size in the sheet discharge direction and is longer than a half of the length of the sheet of the minimum usable size in the sheet discharge direction.

* * * * *